US009514732B2

(12) United States Patent
Wu et al.

(10) Patent No.: US 9,514,732 B2
(45) Date of Patent: Dec. 6, 2016

(54) SOUND-ABSORBING MATERIAL

(71) Applicant: National Taiwan University of Science and Technology, Taipei 106 (TW)

(72) Inventors: Chang-Mou Wu, Douliu (TW); Min-Hui Chou, Taichung (TW); Jiunn-Yih Lee, Taipei (TW)

(73) Assignee: National Taiwan University of Science and Technology, Taipei (TW)

( * ) Notice: Subject to any disclaimer, the term of this patent is extended or adjusted under 35 U.S.C. 154(b) by 0 days.

(21) Appl. No.: 15/008,538

(22) Filed: Jan. 28, 2016

(65) Prior Publication Data

US 2016/0267897 A1 Sep. 15, 2016

(30) Foreign Application Priority Data

Mar. 11, 2015 (TW) ..... 104107705 A

(51) Int. Cl.

| | |
|---|---|
| ***E04B 1/86*** | (2006.01) |
| ***G10K 11/162*** | (2006.01) |
| ***E04B 1/82*** | (2006.01) |
| *E04B 1/74* | (2006.01) |

(52) U.S. Cl.

CPC ..... *G10K 11/162* (2013.01); *E04B 1/8209* (2013.01); *E04B 2001/742* (2013.01)

(58) Field of Classification Search

CPC ..... G10K 11/163; E04B 1/86; E04B 1/8209; E04B 2001/742

USPC ..... 181/286

See application file for complete search history.

(56) References Cited

U.S. PATENT DOCUMENTS

| | | | | |
|---|---|---|---|---|
| 6,051,913 | A * | 4/2000 | King | H04R 1/00 310/322 |
| 6,102,465 | A * | 8/2000 | Nemoto | B60R 13/02 181/286 |
| 6,589,643 | B2 * | 7/2003 | Okada | G10K 11/162 181/201 |
| 8,118,177 | B2 * | 2/2012 | Drapela | B01D 39/1623 181/284 |
| 2013/0327705 | A1 * | 12/2013 | Clark | G10K 11/168 210/508 |

OTHER PUBLICATIONS

C.M. Wu et al., Sound-absorbing Properties of Electrospun PVDF-Graphene Nanofiber Membranes, Annual Meeting of the Polymer Society, Taipei, Jan. 30 and 31, 2015, 1 page, Taiwan.

* cited by examiner

*Primary Examiner* — Forrest M Phillips
(74) *Attorney, Agent, or Firm* — Alan D. Kamrath; Kamrath IP Lawfirm, P.A.

(57) ABSTRACT

A sound-absorbing material has a membrane having multiple piezoelectric fibers, the fiber density of the membrane is below 50 g/m$^2$, the thickness of the membrane is below 1 mm, sound-absorbing coefficient of the membrane is larger than 0.1 at absorbing frequency at 100 Hz+/−10%, and the sound-absorbing coefficient of the membrane is over 0.05 at absorbing frequency at 800 Hz to 1000 Hz. PVDF electrospinning nanofiber membranes of the present invention are thinner and more flexible compared to conventional sound-absorbing material, the membranes in the present invention performs excellent low frequency sound absorption with very thin membrane.

10 Claims, 11 Drawing Sheets

SOUND-ABSORBING MATERIAL

BACKGROUND OF THE INVENTION

1. Field of the Invention

Present invention is related to a sound-absorbing material, especially to a sound-absorbing material absorbing middle to low frequency of sound.

2. Description of the Prior Art

Nowadays, buildings become not only provide shelters but also symbolize quality of life. Governments and technology workers have drawn attention to noise problems. Noise may be controlled mainly in two ways, that is, to reduce or eliminate from a source of noise or to isolate the noise by using sound-absorbing material.

Since it is not easy to find where the noise came from, various kinds of sound-absorbing materials such like acoustic foams or fabrics were developed. With reference to FIG. 11, conventional sound-absorbing material mainly absorbs the sound in high frequency over 1000 Hz and performs bad absorption ability at middle to low frequency. Many researches indicate that middle to low frequency may cause more serious damages to human's healthy than high frequency. Thus, creating a sound-absorbing material mainly absorbing middle to low frequency or even a full frequency sound-absorbing material is necessary.

SUMMARY OF THE INVENTION

In order to solve the shortcomings of conventional sound-absorbing material that performs bad absorption ability in middle or low frequency. A sound-absorbing material absorbs middle to low frequency or a full frequency sound-absorbing material is required.

The present invention involves in a sound-absorbing material has a membrane having multiple piezoelectric fibers, the fiber density of the membrane is below 50 g/m$^2$, the thickness of the membrane is below 1 mm, sound-absorbing coefficient of the membrane is larger than 0.1 at absorbing frequency at 100 Hz+/−10%, and the sound-absorbing coefficient of the membrane is over 0.05 at absorbing frequency at 800 Hz to 1000 Hz.

The sound-absorbing material may further be laminated with an acoustic foam or a non-woven fabric to create a full frequency sound-absorbing material.

According to the above description, the present invention has advantages as following.

1. The present invention has better sound-absorbing ability than conventional sound-absorbing materials, especially in middle to low sound frequencies. Importantly, although the PVDF electrospinning nanofiber membranes described in aforementioned examples of the present invention are extremely thin (<1 mm) and density are all below 50 g/m$^2$, the present invention still performs excellent sound-absorbing ability in middle to low frequency with sound-absorbing coefficient over 0.1 at 100 Hz and over 0.05 at range from 800 Hz to 1000 Hz. A better sound-absorbing ability in 100~1000 Hz may be predicted when the thickness of the present invention is increased.

2. The PVDF electrospinning nanofiber membranes of the present invention are thinner and more flexible compared to conventional sound-absorbing material, the membranes in the present invention has less limitation in use.

3. The present invention may further be assembled with conventional sound-absorbing material to achieve broad-band sound absorber. Since the thickness of the present invention is extremely thin, there has nearly no limitation during use.

DETAILED DESCRIPTION OF THE INVENTION

Figure 1:
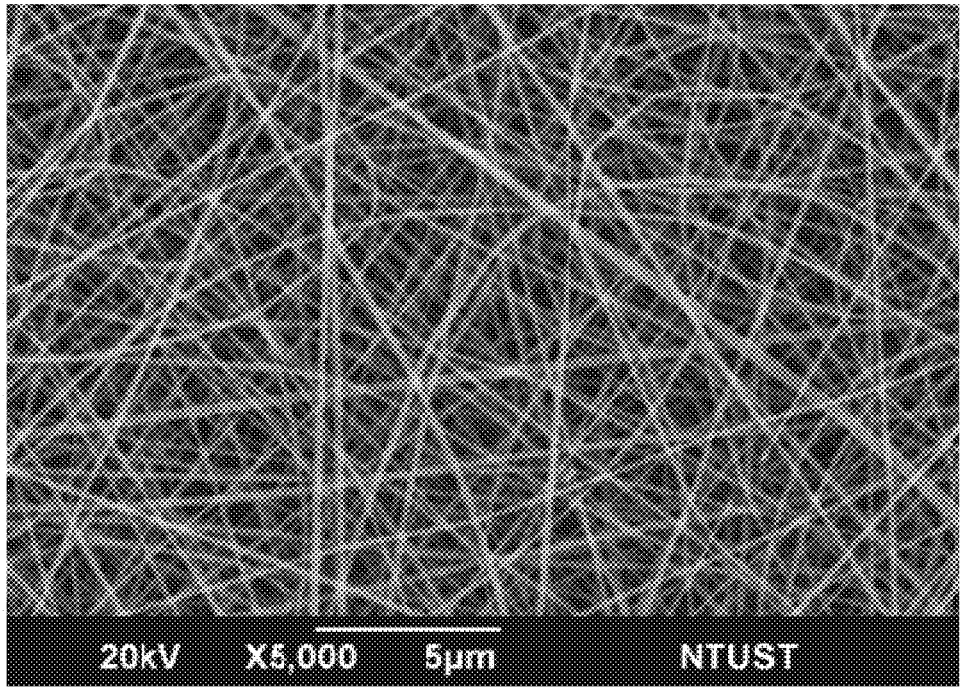
FIG. 1 is a SEM of PVDF electrospinning nanofiber membrane in accordance with an embodiment of the present invention.

In an embodiment of the present invention, a sound-absorbing material comprises a membrane having multiple fibers. The fiber of the membrane is a piezoelectric fiber, preferably a piezoelectric electrospinning nanofiber, more preferably a PVDF (polyvinylidene fluoride) electrospinning nanofiber. The piezoelectric electrospinning nanofiber is nanofibers produced by electrospun process.

The electrospinning nanofiber may be a melting type electrospinning nanofiber or a solution type electrospinning nanofiber. Each PVDF nanofiber of the membrane may further disperse a conductive material therein. Size of the conductive material is preferred to be nano scale in order to be dispersed into the electrospinning nanofiber. The conductive material may be but not limited to graphene (GP), graphene oxide (GO), carbon nanotubes (CNT), nano-gold particles or the mixture thereof.

Preferred embodiments of producing the sound-absorbing material in the present invention are as follows.

Embodiment 1

Step 1: PVDF/DMF-acetone (Polyvinylidene fluoride/N, N-dimethylformamide-acetone) solution is prepared by blending PVDF pellets with a solvent comprising DMF and acetone. Weight ratio of PVDF in PVDF/DMF solution is 15~20 wt %. Volume ratio of PVDF in PVDF/DMF solution is 1:1 to 9:1; the volume ratio thereof is preferably 6:4.

Step 2: The PVDF/DMF solution is stirred at a temperature of approximately 100° C. until the PVDF pellets being fully dissolved. Then the PVDF/DMF solution is cooled down to room temperature of approximately 25° C.

Step 3: PVDF electrospinning nanofiber membrane is produced by directly electrospinning the PVDF/DMF-acetone solution.

Electrospinning conditions are varied to reach suitable properties of the electrospinning nanofiber membrane. The electrospinning conditions for electrospinning the PVDF/DMF-acetone solution in this embodiment may be but not limited to applied voltage 16 kV, working distance 20 cm and flowing rate 0.2 ml/hr. These electrospinning conditions are dependent to an electrospun apparatus being used, the conditions may totally different when different size electrospun apparatus is used.

Embodiment 2

The sound-absorbing material of present invention may further comprises graphene as the conductive material being dispersed therein. Details for producing the embodiment 2 of the present invention are described as below.

Step 1: PVDF/Graphene/DMF-acetone (Polyvinylidene fluoride/Graphene N,N-dimethylformamide) solution is prepared by blending PVDF pellets and graphene with DMF and acetone mixed solvent. Weight ratio of PVDF/Graphene in PVDF/DMF solution is 15~20 wt %. Volume ratio of PVDF in PVDF/DMF solution is 1:1~9:1, the volume ratio thereof is preferably 6:4.

Step 2: The PVDF/Graphene/DMF-acetone solution is stirred at temperature of approximately 100° C. until the PVDF pellets were fully dissolved. The PVDF and graphene and DMF-acetone solution is cooled down to room temperature at approximately 25° C.

Step 3: PVDF/Graphene electrospinning nanofiber membrane is produced by directly electrospinning the PVDF/Graphene/DMF-acetone solution by the electrospun apparatus.

Graphene is conductive and enhances electronic and piezoelectric property of the sound-absorbing material in this embodiment. Other conductive material may also used, such like oxidized graphene, carbon nanotube (CNT) or nano-gold particles.

Electrospinning conditions for electrospinning the PVDF/Graphene/DMF-acetone solution in this embodiment may be but not limited to applied voltage 16 kV, working distance 20 cm and flowing rate 0.2 ml/hr. The working distance is a distance between a nozzle to a target of the electrospun apparatus. Nano fibers are ejected from the nozzle to the target during electrospinning. The flowing rate in this embodiment may be considered as flowing speed of the PVDF/Graphene/DMF-acetone solution from the nozzle.

Morphology, crystalline and sound-absorbing properties of the present invention are shown as followings by using scanning electron microscopy (SEM), atomic force microscope (AFM), X-ray diffraction (XRD) and fourier transform infrared spectroscopy (FTIR).

Figure 2:
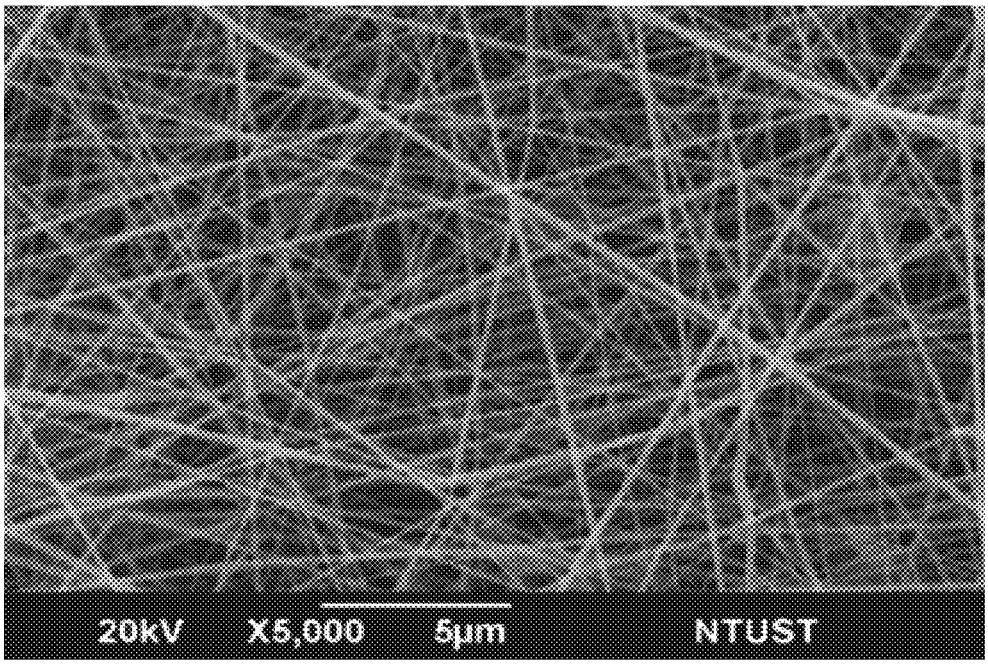
FIG. 2 is a SEM of PVDF/Graphene electrospinning nanofiber membrane in accordance with an embodiment of the present invention.
Figure 3:
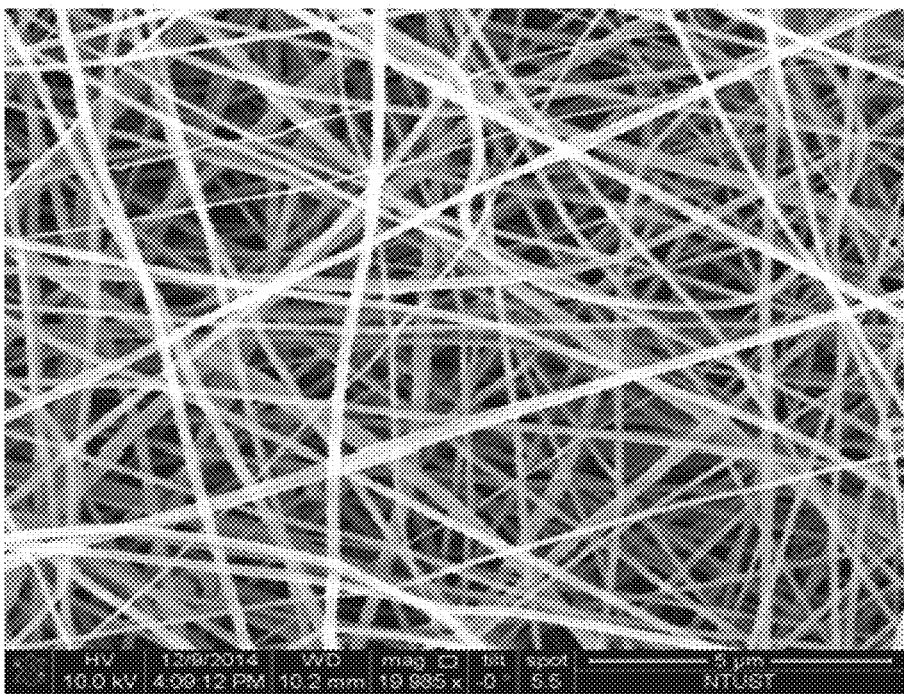
FIG. 3 is a SEM of PVDF/CNT electrospinning nanofiber membrane in accordance with an embodiment of the present invention.

With reference to FIG. 1 to FIG. 3, pictures of SEM of PVDF electrospinning nanofiber membrane, PVDF/Graphene electrospinning nanofiber membrane and PVDF/CNT electrospinning nanofiber membrane are shown. FIG. 1 to FIG. 3 indicate the PVDF electrospinning nanofiber membranes with or without the conductive materials may be all successfully prepared. Average diameter of the PVDF electrospinning nanofiber membrane shown in FIG. 1 is 156+/−13 nm. Average diameter of the PVDF/graphene electrospinning nanofiber membrane shown in FIG. 2 is 169+/−21 nm. Average diameter of the PVDF/CNT electrospinning nanofiber membrane shown in FIG. 1 is 138+/−21 nm.

Figure 4:
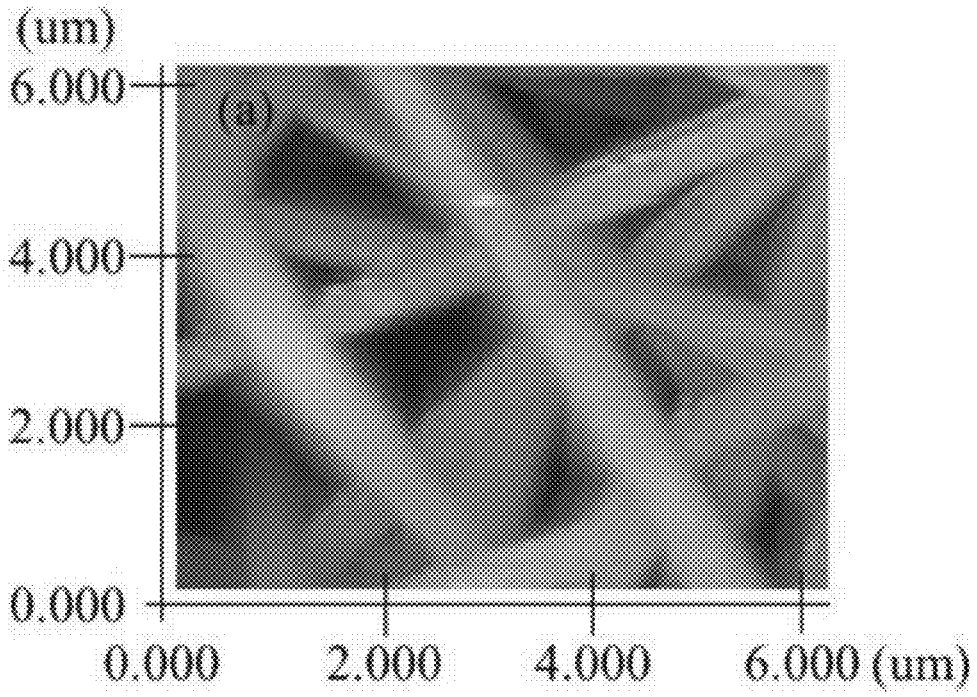
FIG. 4 is AFM of PVDF electrospinning nanofiber membrane in accordance with an embodiment of the present invention.
Figure 5:
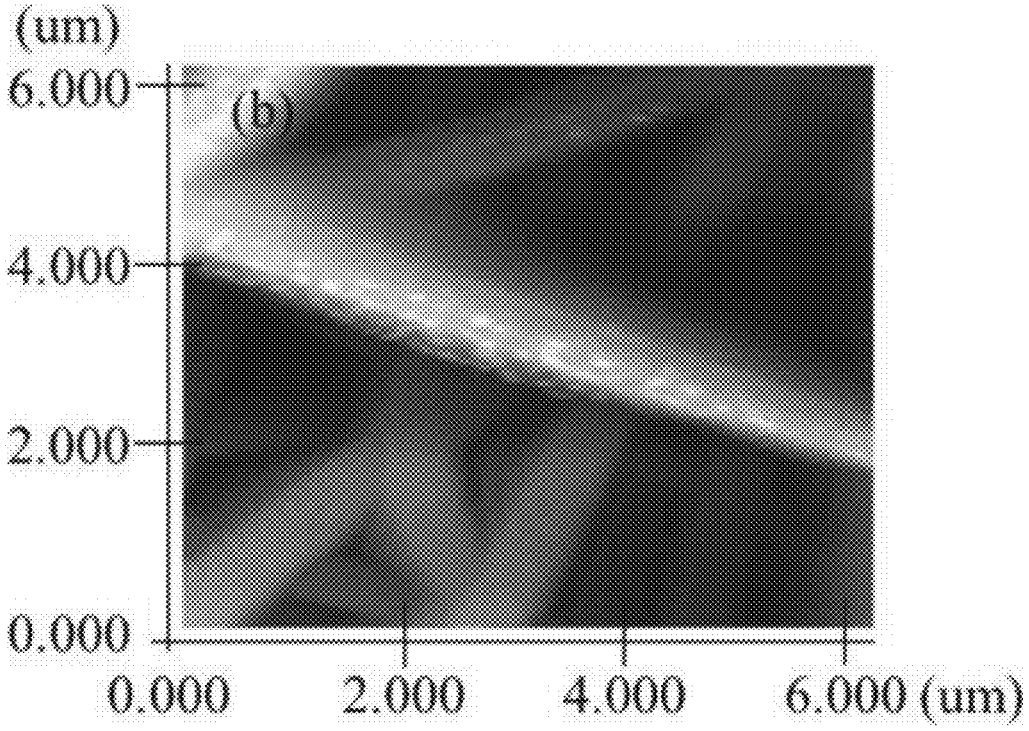
FIG. 5 is a AFM of PVDF/Graphene electrospinning nanofiber membrane in accordance with an embodiment of the present invention.

With reference to FIG. 4 to FIG. 5, pictures of AFM of PVDF electrospinning nanofiber membrane and PVDF/Graphene electrospinning nanofiber membrane are shown. Surface of the PVDF electrospinning nanofiber membrane and the PVDF/graphene electrospinning nanofiber membrane appear rugged, sound absorbing test shows the PVDF electrospinning nanofiber membrane and the PVDF/graphene electrospinning nanofiber membrane sound absorbing property of the present invention significantly.

PVDF exist over five different crystallization structures, where α-phase thereof is dominant but PVDF with β-phase crystallization shows better piezoelectric property and sound-absorbing property. PVDF with β-phase crystallization may be obtained by mechanical stretching process or heat treatment. The present invention provides a different method to transform PVDF from α-phase into β-phase crystallization by applied high electric field during electrospinning process. PVDF electrospun nanofiber membrane with piezoelectricity is produced without conventional post treatments such like heat treatment or mechanical stretched.

Figure 6:
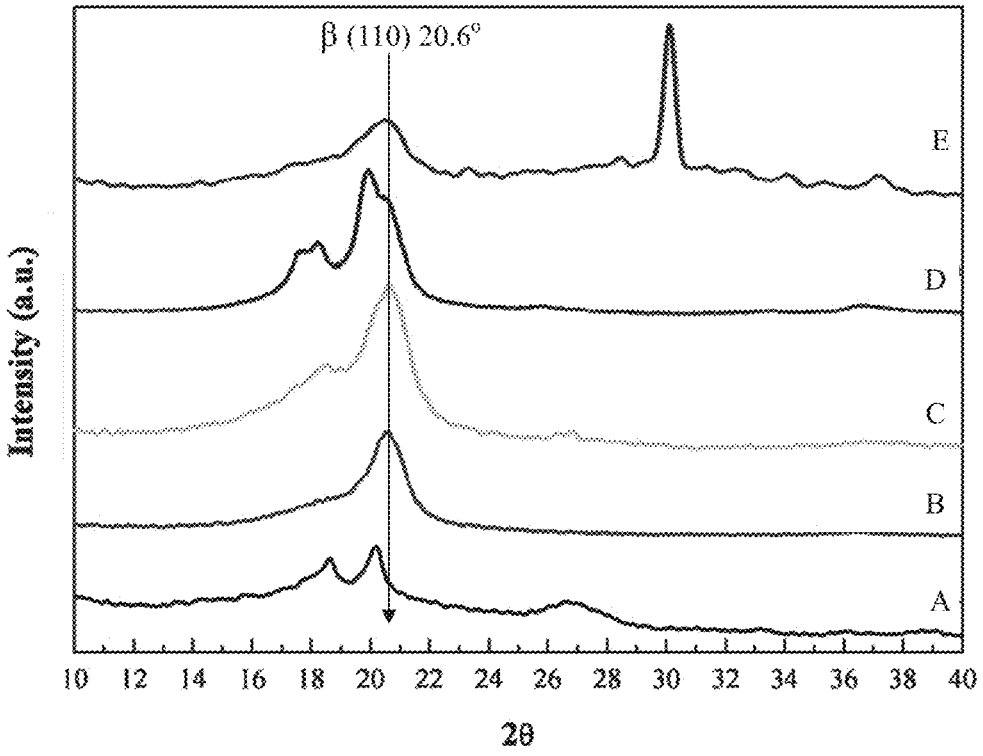
FIG. 6 is a XRD of Example A to E in accordance with the present invention.
Figure 7:
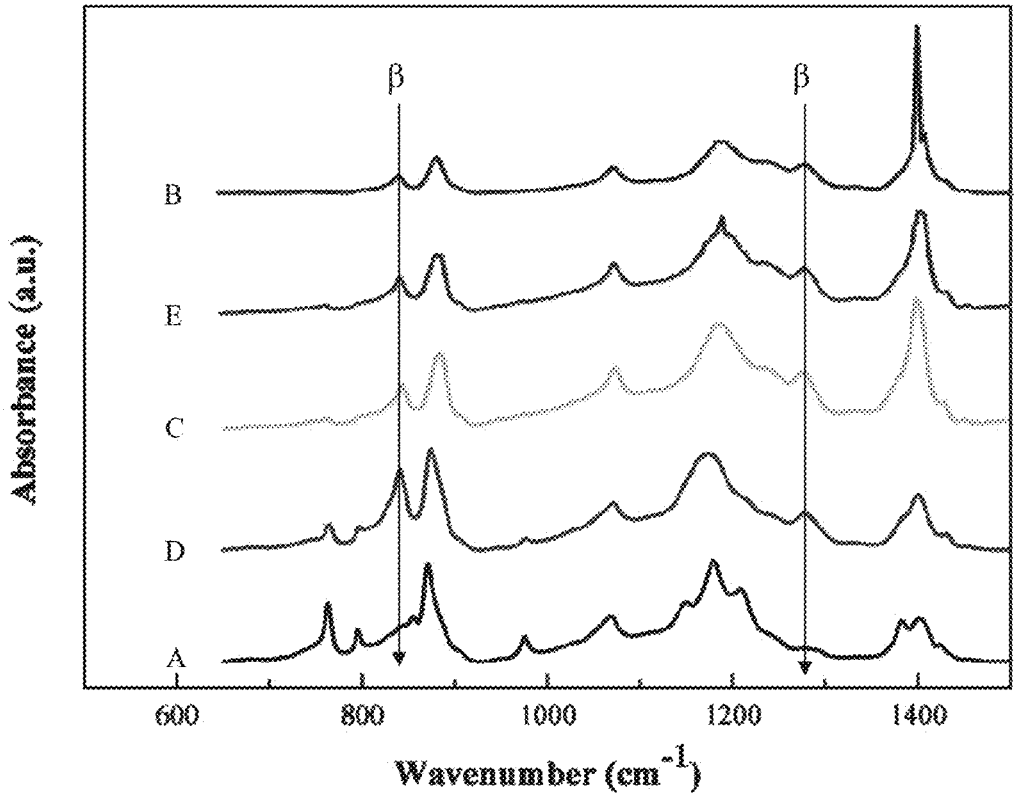
FIG. 7 is FTIR spectra of Example A to E in accordance with the present invention.

With reference to FIG. 6 to FIG. 7 and Table 1, Example A to E were conventional PVDF film and PVDF electrospinning nanofiber membrane being subjected to different treatments to obtain β-phase crystallization, wherein the Example A is untreated conventional PVDF film; Example B indicates untreated PVDF electrospinning nanofiber membrane of the present invention; Example C indicates untreated PVDF/Graphene electrospinning nanofiber membrane of the present invention; Example D indicates mechanical stretched conventional PVDF film with 3.5 times length (stretching ratio: 3.5); and Example E indicates untreated PVDF and CNT electrospinning nanofiber membrane of the present invention. Densities of Example A, B, C, D and E are respectively 156.3 $g/m^2$, 39.1 $g/m^2$, 45.5 $g/m^2$, 97.6 $g/m^2$ and 56.52 $g/m^2$. Thickness of Example A to E is range from 0.2 mm to 0.3 mm.

FIG. 6 illustrates XRD of Example A to E, wherein diffraction angle with 20.6° (110) represent β-phase crystallization of PVDF. Example B, C, and E are all PVDF with β-phase crystallization as shown in FIG. 6, the diffraction angle thereof is 20.6° (110). Example D, the conventional PVDF film being mechanical stretched for 3.5 times elongation, also appears diffraction peak at 20.6° (110), which shows the Example D is β-phase PVDF. Example A does not appear peak at 20.6°, which shows Example A is not β-phase PVDF.

FIG. 6 demonstrates that all the PVDF electrospinning nanofiber membranes of the present invention are successfully produced with β-phase crystallization. With reference to FIG. 7, FTIR spectrum of Example A to E are shown, the results show the Example B, C, and E comprise β-phase PVDF.

With reference to Table 1, β-phase fraction (F(β)) and piezoelectric coefficient($d_{33}$) of Example A to E are listed. Example B, C, and E of the present invention contain higher content of β-phase PVDF than Example A and D. Example B, C, and E of the present invention also have better piezoelectric property than Example A and D.

| Example | F (β) | $d_{33}$ |
|---|---|---|
| A | 24% | 10.5 |
| B | 76% | 15.2 |
| C | 76% | 19.2 |
| D | 70% | 11.7 |
| E | 65% | 18.8 |

Figure 8:
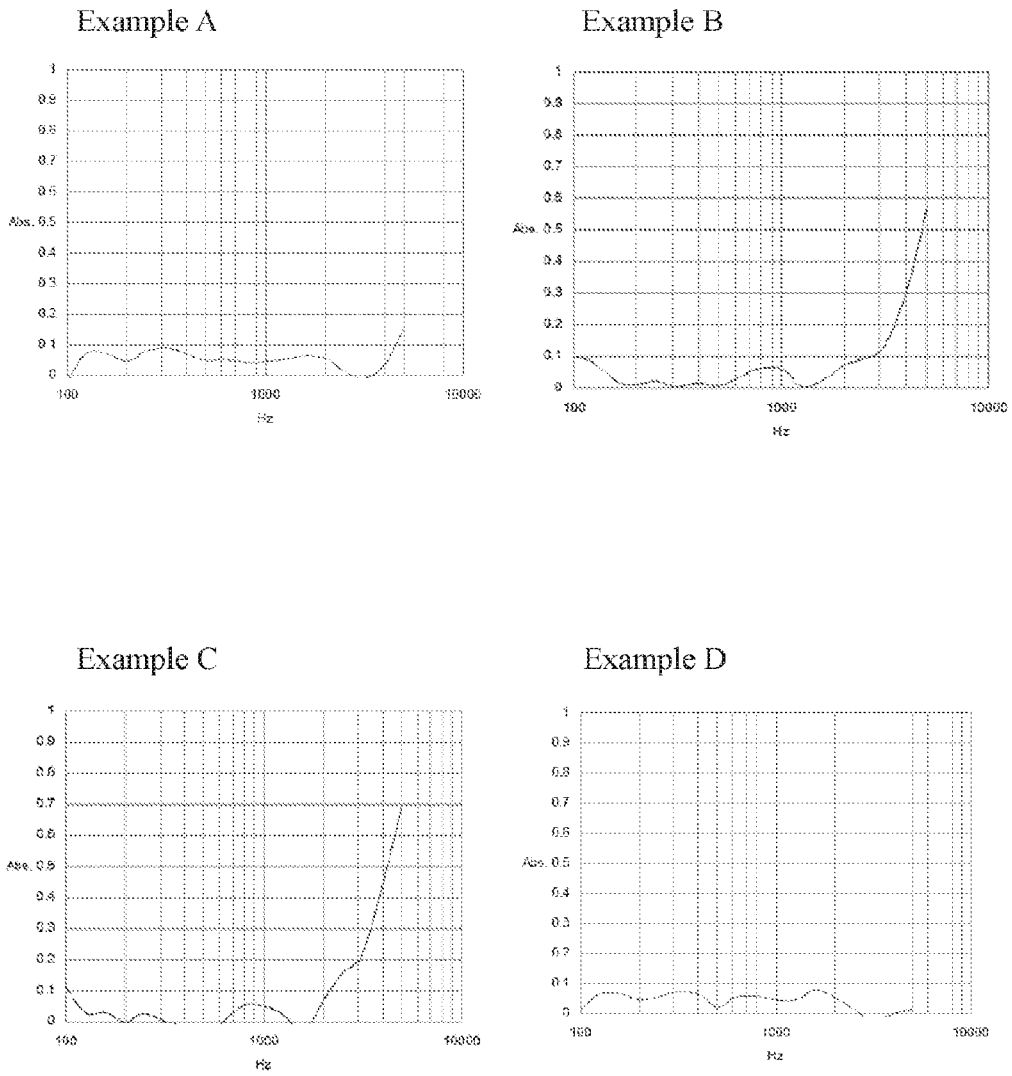
FIG. 8 is diagrams of sound-absorbing coefficient versus frequency of Example A to D in accordance with the present invention.
Figure 9:
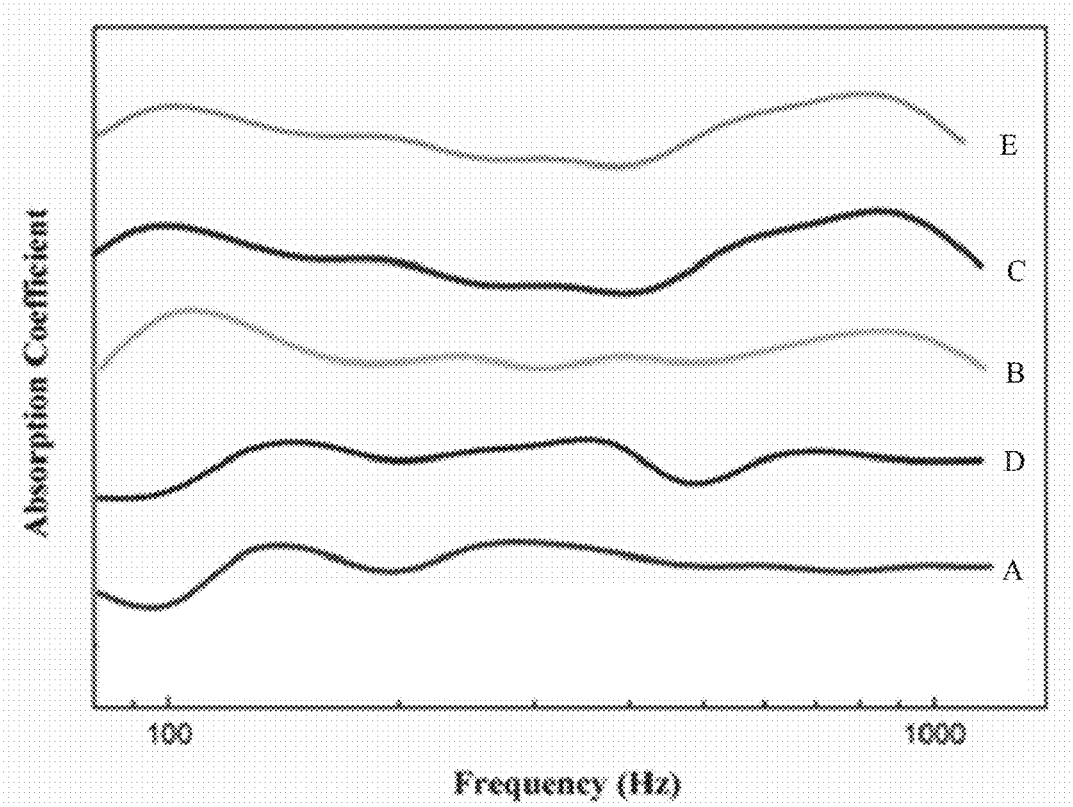
FIG. 9 is diagrams of sound-absorbing coefficient versus frequency of Example A to E in accordance with the present invention.

With reference to FIG. 8 and FIG. 9, diagrams of sound-absorbing coefficient versus frequency of Example A to E are shown. Example B and C of the present invention have better performance in absorbing middle to low frequency than Example A and D. Absorption frequency band of Example C shifted to lower frequency region around 100 Hz as shown in FIG. 9, the result indicates that the conductive material may enhance the electronic and piezoelectric properties. The property of piezoelectric in the present invention is believed to be related to low frequency sound absorption. Aforementioned "high frequency" may be defined as sound over 1000 Hz. The "middle frequency" refers to 400 Hz to 1000 Hz. Low frequency refers to frequency below 400 Hz.

To improve an absorption band width of the sound-absorbing material, laminates the aforementioned membranes and other sound absorbing material such like acoustic absorbing foam or non-woven fabric are revealed. A broad bandwidth sound-absorbing material is achieved.

Figure 10:
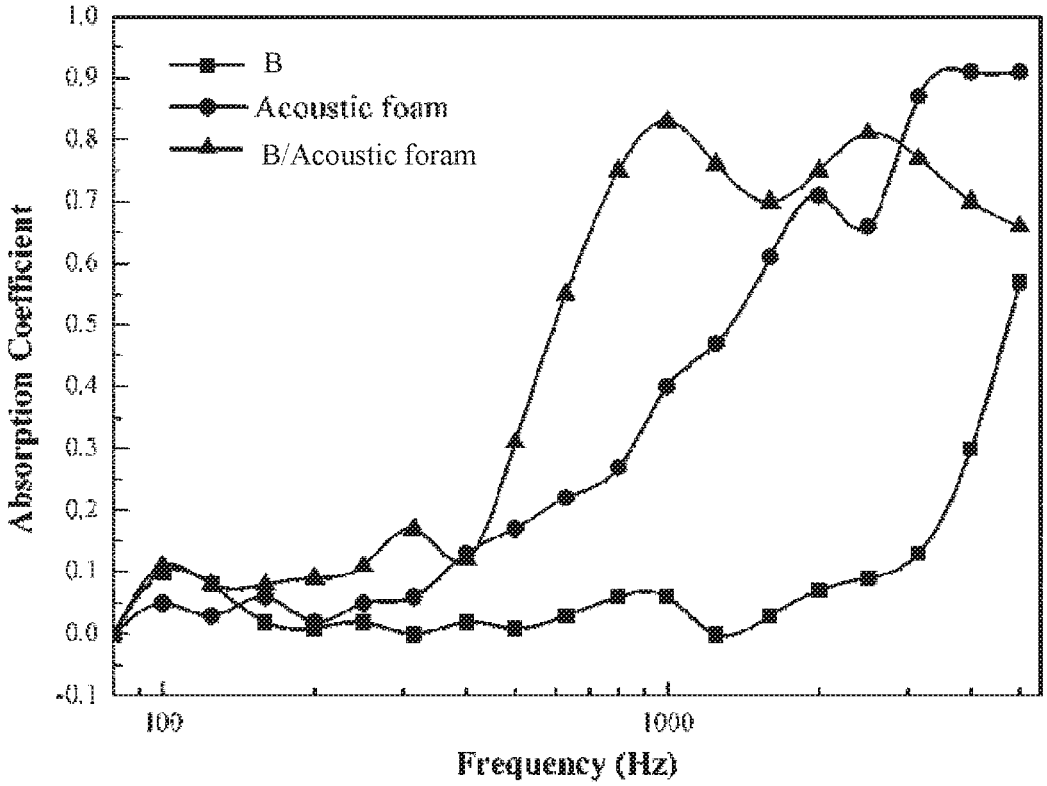
FIG. 10 is diagram of sound-absorbing coefficient versus frequency of Example B, Example B being laminated with a conventional acoustic foam and the conventional acoustic foam.
Figure 11:
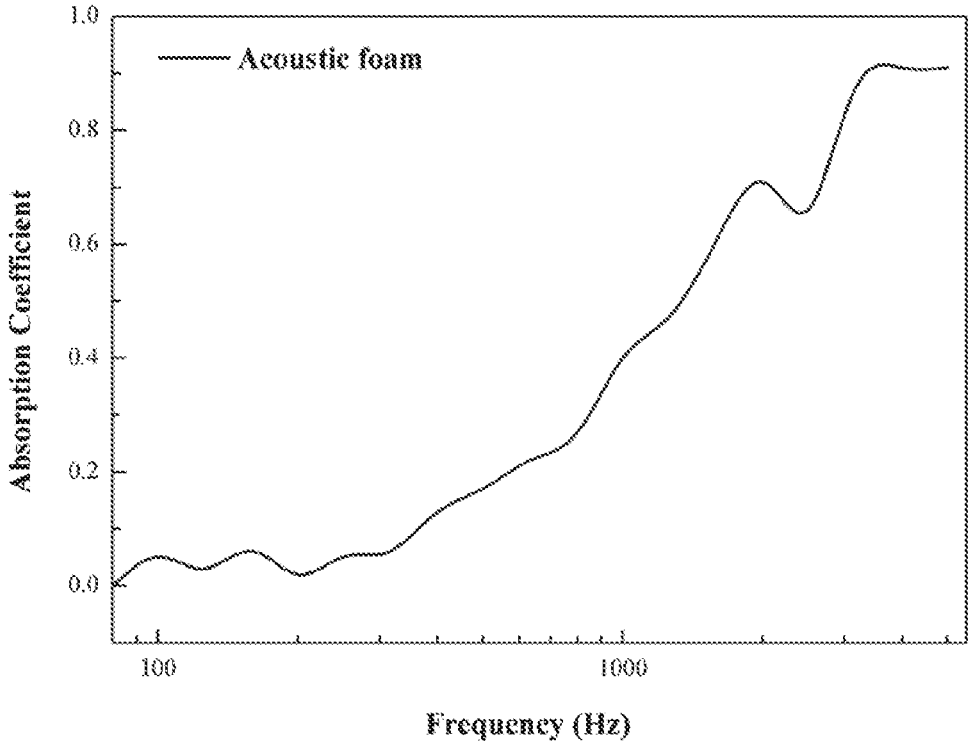
FIG. 11 is a diagram of sound-absorbing coefficient versus frequency of the conventional sound-absorbing material.

With reference to FIG. 10, a sound absorbing coefficient test result for the Example B being laminated with one conventional acoustic foam and conventional acoustic foam are shown. Thickness of the conventional acoustic foam is 25 mm. Density of the conventional acoustic foam is 250.52 $g/m^2$. Example B and conventional acoustic foam laminated structure of the present invention is able to absorb middle to low frequency of sound ranging from 90 to 1000 Hz. Example B have over 0.5 sound-absorbing coefficient in extra low frequency at 90 to 150 Hz. The present invention performs better sound-absorbing property in middle to low frequency than conventional acoustic foam. The present invention may be used with conventional sound-absorbing materials to achieve a broadband absorber.

Thus, the present invention has advantages as following.

1. The present invention has better sound-absorbing ability than conventional sound-absorbing materials, especially in middle to low sound frequencies. Importantly, although the PVDF electrospinning nanofiber membranes described in aforementioned examples of the present invention are extremely thin (<1 mm) and density are all below 50 $g/m^2$, the present invention still performs excellent sound-absorbing ability in middle to low frequency with sound-absorbing coefficient over 0.1 at 100 Hz and over 0.05 at range from 800 Hz to 1000 Hz. A better sound-absorbing ability in 100~1000 Hz may be predicted when the thickness of the present invention is increased.

2. The PVDF electrospinning nanofiber membranes of the present invention are thinner and more flexible compared to conventional sound-absorbing material, the membranes in the present invention has less limitation in use.

3. The present invention may further be assembled with conventional sound-absorbing material to achieve broadband sound absorber. Since the thickness of the present invention is extremely thin, there has nearly no limitation during use.

What is claimed is:

1. A sound-absorbing material comprising a membrane having multiple piezoelectric fibers, wherein:

a density of the membrane is below 50 $g/m^2$;

a thickness of the membrane is below 1 mm;

the multiple piezoelectric fibers are polyvinylidene fluoride electrospun fibers containing at least 65% of β-phase polyvinylidene fluoride crystallization;

a sound-absorbing coefficient of the membrane is larger than 0.1 at an absorbing frequency at 100 Hz+/−10%; and the sound-absorbing coefficient of the membrane is over 0.05 at the absorbing frequency at 800 Hz to 1000 Hz.

2. The sound-absorbing material as claimed in claim 1, wherein:

a conductive material is dispersed in the multiple piezoelectric fibers and the absorbing frequency of the sound-absorbing material with the conductive material at 100 Hz+/−10% is shifted toward a lower frequency by 0.1~10%;

the sound-absorbing coefficient of the membrane is larger than 0.1; and the conductive material comprises graphene, graphene oxide, carbon nano tube, nano gold or the mixture thereof.

3. The sound-absorbing material as claimed in 1, wherein a polyvinylidene fluoride solution for electrospinning comprises the conductive material, acetone and N,N-dimethylformamide.

4. The sound-absorbing material as claimed in claim 2, wherein a polyvinylidene fluoride solution for electrospinning comprises the conductive material, acetone and N,N-dimethylformamide.

5. The sound-absorbing material as claimed in claim 3, wherein:

a weight ratio of the polyvinylidene fluoride in the polyvinylidene fluoride solution ranges from 15 wt % to 20 wt %;

a volume ratio of the polyvinylidene fluoride to the acetone and the N,N-dimethylformamide in the polyvinylidene fluoride solution ranges from 1:1 to 9:1; and a weight ratio of the conductive material in the polyvinylidene fluoride solution ranges from 0.1 wt % to 10 wt %.

6. The sound-absorbing material as claimed in claim 3, wherein:

a weight ratio of the polyvinylidene fluoride in the polyvinylidene fluoride solution ranges from 15 wt % to 20 wt %;

a volume ratio of the polyvinylidene fluoride to the acetone and the N,N-dimethylformamide in the polyvinylidene fluoride solution ranges from 1:1 to 9:1; and a weight ratio of the conductive material in the polyvinylidene fluoride solution ranges from 0.1 wt % to 10 wt %.

7. The sound-absorbing material as claimed in claim 5, wherein:

the weight ratio of the polyvinylidene fluoride in the polyvinylidene fluoride solution is 18 wt %; and the volume ratio of the polyvinylidene fluoride to the acetone and the N,N-dimethylformamide in the polyvinylidene fluoride solution is 6:4.

8. The sound-absorbing material as claimed in claim 6, wherein:

the weight ratio of the polyvinylidene fluoridein the polyvinylidene fluoride solution is 18 wt %; and the volume ratio of the polyvinylidene fluoride to the acetone and the N,N-dimethylformamide in the polyvinylidene fluoride solution is 6:4.

9. The sound-absorbing material as claimed in claim 7, wherein the membrane is laminated with an acoustic foam or a non-woven fabric to have the sound-absorbing coefficient over 0.05 at the absorbing frequency over 80 Hz.

10. The sound-absorbing material as claimed in claim 8, wherein the membrane is laminated with an acoustic foam or a non-woven fabric to have the sound-absorbing coefficient over 0.05 at the absorbing frequency over 80 Hz.

* * * * *